US005641542A

United States Patent [19]

Melzer et al.

[11] Patent Number: 5,641,542

[45] Date of Patent: Jun. 24, 1997

[54] CHROMIUM-FREE ALUMINUM TREATMENT

[75] Inventors: Jeffrey I. Melzer, Lansdale; Barry P. Gunagan, Hatboro, both of Pa.

[73] Assignee: BetzDearborn Inc., Trevose, Pa.

[21] Appl. No.: 541,063

[22] Filed: Oct. 11, 1995

[51] Int. Cl.[6] ..... B05D 3/04; B05D 3/10

[52] U.S. Cl. ..... 427/302; 148/247; 148/251; 427/327; 427/421; 427/428; 427/435

[58] Field of Search ..... 148/243, 247, 148/251, 283; 427/327, 302, 421, 428, 435

[56] References Cited

U.S. PATENT DOCUMENTS

| | | | |
|---|---|---|---|
| 1,710,743 | 4/1929 | Pacz . | |
| 3,539,403 | 11/1970 | Ries | 148/6.14 |
| 4,136,073 | 1/1979 | Muro et al. | 260/29.2 EP |
| 4,191,596 | 3/1980 | Dollman et al. | 148/6.29 |
| 4,370,177 | 1/1983 | Frelin et al. | 148/6.27 |
| 4,422,886 | 12/1983 | Das et al. | 148/31.5 |
| 4,496,404 | 1/1985 | King | 148/6.14 R |
| 4,921,552 | 5/1990 | Sander et al. | 148/247 |
| 5,114,607 | 5/1992 | Deck et al. | 252/156 |
| 5,158,622 | 10/1992 | Reichgott et al. | 148/247 |
| 5,281,282 | 1/1994 | Dolan et al. | 148/247 |
| 5,292,379 | 3/1994 | Reichgott et al. | 148/251 |
| 5,328,525 | 7/1994 | Musingo et al. | 148/247 |
| 5,344,504 | 9/1994 | Deck et al. | 148/243 |
| 5,401,333 | 3/1995 | Ouyang et al. | 148/241 |

FOREIGN PATENT DOCUMENTS

| | | |
|---|---|---|
| 2165165 | 4/1986 | United Kingdom . |
| WO8505131 | 11/1985 | WIPO . |
| WO9305198 | 3/1993 | WIPO . |

*Primary Examiner*—Michael Lusignan

*Attorney, Agent, or Firm*—Alexander D. Ricci; Matthew W. Smith

[57] ABSTRACT

A method of forming a protective coating on aluminum and aluminum alloy surfaces to improve adherence of siccative coatings such as inks, paints, and lacquers. The method involves rinsing acid treatments from aluminum surfaces followed by coating the aluminum surfaces with a polymeric composition. The method provides improved adhesion of siccative coverings to treated aluminum surfaces over chrome containing and non-chrome containing fluoroacid and polymer mixture treatments.

8 Claims, No Drawings

CHROMIUM-FREE ALUMINUM TREATMENT

FIELD OF THE INVENTION

The invention relates generally to non-chromate coatings for metals. More particularly, the present invention relates to a method for applying a non-chromate coating onto aluminum which improves the adhesion of siccative coatings to aluminum surfaces.

BACKGROUND OF THE INVENTION

The purposes of the formation of a chromium phosphate conversion coating on the surface of aluminum are to provide corrosion resistance, by enhancing the adhesion of siccative coatings and for esthetic reasons. The conversion coating improves the adhesion of siccative coatings such as paints, inks, and lacquers. A chromium phosphate conversion coating is typically provided by contacting aluminum with an aqueous composition containing hexavalent or trivalent chromium ions, phosphate ions and fluoride ions. Growing concerns exist regarding the pollution effects of the chromate and phosphate discharged into rivers and waterways by such processes. Because of high solubility and the strongly oxidizing character of hexavalent chromium ions, conventional chromate conversion processes require extensive waste treatment procedures to control their discharge. In addition, the disposal of the solid sludge from such waste treatment procedures is a significant problem.

Attempts have been made to produce an acceptable chromate-free conversion coating for aluminum. Chromate-free pretreatment coatings based upon combinations of complex fluoacids and polyacrylic acids which are applied as a single step treatment and dried in place are known in the art. U.S. Pat. No. 4,191,596 which issued to Dollman et al., discloses a composition for coating aluminum which comprises a polyacrylic acid or esters thereof and $H_2ZrF_6$, $H_2TiF_6$ or $H_2SiF_6$. U.S. Pat. No. 4,921,552 which issued to Sander et al., discloses a non-chromate coating for aluminum which is dried in place. The aqueous coating composition consists essentially of more than 8 grams per liter of dihydrohexafluozirconic acid, more than 10 grams per liter of water soluble acrylic acid and homopolymers thereof and more than 0.17 grams per liter of hydrofluoric acid. The disclosure also notes that it was believed copolymers of acrylic acid would also be effective.

Compositions which include an acid and a polymer in a single treatment and which are rinsed to remove excess acid and polymer are known in the art. U.S. Pat. No. 4,136,073 which issued to Muro et al., discloses a composition and process for the treatment of aluminum surfaces using an aqueous acidic bath containing an organic film-forming polymer and a water soluble titanium compound. The disclosed polymers include vinyl polymers and copolymers derived from monomers such as vinyl acetate, vinylidene chloride, vinyl chloride; acrylic polymers and copolymers derived from monomers such as acrylic acid, methacrylic acid, acrylic esters, methacrylic esters and the like; aminoalkyd epoxy, urethane-polyester, styrene and olefin polymers and copolymers; and natural and synthetic rubbers. Treated panels are rinsed with water and dried after immersion in the treatment solutions.

It is also known to remove excess aqueous multiple component acidic solutions from metal surfaces prior to treatment with a polymer. U.K. Patent Application GB 2165165A discloses an aluminum metal surface treatment process comprising sequentially cleaning a metal surface with preferably an alkali cleaner; rinsing the metal surface with water; contacting the metal surface with an aqueous acidic treatment composition; rinsing the metal surface with water; and contacting the metal surface with a post treatment solution containing derivatives of polyalkenylphenol polymers and drying the metal surface. The aqueous acidic treatment composition comprises dissolved metal ions selected from the group consisting of hafnium, zirconium, titanium and mixtures thereof; phosphate ions; fluoride ions; a vegetable tannin compound; and a sequestering agent.

SUMMARY OF THE PRESENT INVENTION

The present invention provides a method of treating the surface of aluminum and alloys thereof in which aluminum is the primary component to provide a coating which increases the adhesion properties of siccative coatings to the aluminum surface. The method comprises cleaning the surface of the aluminum; rinsing the cleaning solution from the surface; contacting the surface with a chromium-free fluoroacid solution consisting essentially of a fluoroacid in water; rinsing the chromium-free fluoroacid solution from the surface and coating the surface with a polymeric composition. The multi-step method of the present invention provides enhanced surface adhesion of siccative coatings to treated aluminum surfaces.

DETAILED DESCRIPTION OF THE PREFERRED EMBODIMENTS

The inventors of the present invention have discovered that treating an aluminum surface with a fluoroacid and water solution, rinsing the fluoroacid and water treatment from the surface of aluminum followed by application of selected polymeric coatings significantly improves siccative coating adherence to the aluminum over known treatment methods. Specifically, a method comprising the sequential steps of 1 ) cleaning the aluminum surface; 2) rinsing the cleaning solution from the aluminum surface 3) treating the aluminum surface with an acidic composition consisting essentially of water and an acid selected from the group consisting of $H_2TiF_6$, $H_2ZrF_6$, $H_2SiF_6$, $HBF_4$; or mixtures thereof; 4) rinsing the acidic composition from the aluminum surface; 5) coating the aluminum surface with a polymeric composition selected from the group consisting of polyacrylic acid, polyvinyl alcohol, acrylic acid/acrylamide copolymers and mixtures thereof; and 6) drying the polymeric composition on the aluminum surface improves the adhesion of siccative coatings to aluminum and aluminum alloys.

The cleaning step can be conducted with any conventional cleaner known to those skilled in the art to remove grease and other contaminants from aluminum. Either an acid or an alkaline cleaner can be used. Preferably aqueous alkaline cleaners at temperatures of about 100° F. to about 160° F. can be used followed by a water rinse. Optionally the water rinse can include a neutralizing acid such as phosphoric or nitric acid to neutralize the alkaline component of the cleaner. Suitable cleaners include Kleen® 148 and 155, available commercially from Betz Laboratories, Inc.

Rinsing before and after fluoroacid treatment can be conducted with any water which does not leave deposits or contamination on the metal surface such as tap or deionized water.

The fluoroacid treatment step is conducted with aqueous solutions of $H_2TiF_6$, $H_2ZrF_6$, $HBF_4$, $H_2SiF_6$ or mixtures thereof at pH's from about 2 to 5, and preferably 2.5 to 4, and at temperatures from about 90° F. to about 150° F. The preferred acids are $H_2TiF_6$ and $H_2ZrF_6$ or mixtures thereof. $H_2TiF_6$ is available commercially as 60% by weight $H_2TiF_6$ in water (60% actives). $H_2ZrF_6$ is available commercially as 45% by weight $H_2ZrF_6$ in water (45% actives). The acid concentration in the fluoroacid treatment step can range from about 1 gram of fluoroacid per liter of water (g/L) to about 100 grams of fluoroacid per liter of water. Preferably the fluoroacid concentration in the acid treatment step is from about 2 g/L to about 50 g/L and most preferably from about 3 g/L to about 15 g/L. If necessary, pH adjustment can be obtained by addition of materials such as $NH_4OH$ or $HNO_3$ to maintain the desired pH range. The acid solution is effective for treating aluminum surfaces without the need for phosphate ions, tannin compounds, hafnium ions or sequestering agents in the acidic solution.

The polymer coating is a composition selected from the group consisting of polyacrylic acid, polyvinyl alcohol, acrylic acid/acrylamide copolymer, and mixtures thereof. Such polymeric compositions include polyacrylic acid available commercially as Acumer® 1510 from Rohm & Haas, polyvinyl alcohol available commercially from Air Products as Airvol® 740 and a mixture of acrylic acid/acrylamide copolymer and polyvinyl alcohol available commercially as Betz Chemseal® 768A from Betz Laboratories, Inc. The polymer composition is applied after the aluminum surface has been rinsed to remove excess acid treatments and is allowed to dry before application of siccative coatings.

The polymer coating is applied as a polymer or polymer mixture in an aqueous solution. The concentration of polymer in the aqueous solution can range from about 0.1 grams of polymer actives per liter of aqueous solution (g/L) to about 10 g/L. Preferably, the polymer concentration is about 0.2 g/L to about 1 g/L and most preferably the polymer concentration is about 0.45 g/L. Although a single polymer can be used as a polymeric coating in the invention process, a mixture of acrylic acid/acrylamide copolymer and polyvinyl alcohol is preferred.

The preferred molar ratio of acrylic acid to acrylamide in the copolymer is about 7:3. In the mixture of copolymer and polyvinyl alcohol a mixture having ratios of parts by weight acrylic acid/acrylamide copolymer to parts by weight polyvinyl alcohol of from about 4:3 to about 5:12 is preferred and from about 1:1 to about 5:4 is most preferred.

The sequential steps of cleaning, rinsing, acid treatment, rinsing and polymer coating can be applied by any of several techniques familiar to those skilled in the art, such as roll coating, dip/squeegee, spray, immersion and the like. Preferably, the steps are applied by immersion or spray techniques.

Following application of the polymer coating, the polymer coating is allowed to dry under ambient conditions or is placed under forced air or in an oven to speed drying of the polymer. A siccative coating can then be applied over the dried polymer coating.

The invention will now be further described with reference to a number of specific examples which are to be regarded solely as illustrative and not restricting the scope of the invention.

EXAMPLE I

To demonstrate the efficacy of rinsing fluoroacid treatments from aluminum before applying a polymer coating, extruded aluminum panels were cleaned with a 3% by volume solution of Kleen® 148, at 140° F. in a 40 second spray. The panels were rinsed with tap water, treated with various acid and polymer treatments followed by drying and painting.

Eleven cuts, 2 mm apart were made in the paint on each aluminum strip. A second set of eleven cuts were made perpendicular to the first set of cuts to form cross hatched scores on the paint film of each strip. The strips were immersed in boiling deionized water for 20 minutes, removed, dried and allowed to equilibrate to room temperature. Permecel® 99 tape was placed over the cross-hatched areas and then the tape was removed. Ratings of from 0 (complete paint removal) to 10 (no paint removal) were then given to each strip tested. The treatments for each strip tested in Example I are shown in Table IA.

TABLE IA

Treatment A—Multi-Step

1. Acid treatment: 4 g/L of $H_2TiF_6$ (60% active) at pH 2.5 adjusted with $NH_4OH$. The treatment was applied as a 30 second spray at 130° F.
2. Tap water rinse.
3. Polymer coating: 1 g/L of Acumer® 1510 (25% actives) in water applied at ambient temperature as a 30 second spray.

Treatment B—No Rinse

1. Acid treatment: A mixture of 4 g/L of $H_2TiF_6$ (60% active) and 1 g/L of Acumer® 1510 (25% actives) in water at pH 2.5 and 130° F. applied in a 30 second spray.
2. Drying.

Treatment C—No Rinse

1. Acid treatment: 2% Permatreat® 611 ($H_2TiF_6$+an acrylic acid/allyl ether copolymer in water, available commercially from Betz Laboratories, Inc.), at pH 2.2–2.5 and ambient temperature, applied as a 30 second spray.
2. Drying.

Treatment D—Chrome Phosphate

1. Acid treatment: 40 second immersion in a 3% by volume aqueous solution of chromic acid and phosphoric acid (available commercially as Permatreat® 640 from Betz Laboratories, Inc.) mixed with an 0.5% by volume aqueous solution of HF (available commercially as Permatreat® 645 from Betz Laboratories, Inc.) at a temperature of 100°–120° F.
2. Tap water rinse.
3. Deionized water rinse.
4. Drying.

The treatments' effectiveness at maintaining paint adhesion are shown in Table IB.

TABLE IB

| | Boiling Water/Adhesion Results | | |
|---|---|---|---|
| Treatment | PPG Polycron White UC71394 | PPG Polycron Bronze UC58836 | Morton Black 10K85 |
| A | 9/9 | 9/9 | 9/6 |
| B | 5/5 | 0/2 | 0/0 |
| C | 7/9 | 5/5 | 3/5 |
| D | 9/9 | 7/7 | 9/8 |

where #/# denotes duplicate panels.

Example I shows that Treatment A, the multi-step method, provided superior paint adherence to the two no rinse treatments B and C and the chrome-phosphate treatment D.

EXAMPLE II

Extruded aluminum panels were treated and subjected to the scoring and boiling test described in Example I. The treatments tested are shown in Table IIA.

TABLE IIA

Treatment E—No Rinse

1. Acid treatment: 6 g/L of $H_2TiF_6$ (60% actives) and 1 g/L of Acumer® 1.510 (25% actives) in water at pH 2.8 and 115° F. in a 30 second spray.
2. Drying.

Treatment F—Multi-Step

1. Acid treatment: 6 g/L of $H_2TiF_6$ (60% actives) in water at pH 2.8 and 115° F. applied in a 30 second spray.
2. Tap water rinse.
3. Polymer coating: 1 g/L of Acumer® 1510 (25% actives) in water applied at ambient temperature as a 30 second spray.
4. Drying.

Treatment G—Multi-Step

1. Acid treatment: 6 g/L of $H_2TiF_6$ (60% actives) in water at pH 2.8 and 115° F. applied in a 30 second spray.
2. Tap water rinse.
3. Polymer coating: 1 g/L of Acumer® 1510 (25% actives) and 0.2 g/L of Airvol® 540 in water applied as a 30 second spray at ambient temperature.
4. Drying.

Treatment H—Multi-Step

1. Acid treatment: 6 g/L of $H_2TiF_6$ (60% actives) in water at pH 2.8 and 115° F. applied in a 30 second spray.
2. Tap water rinse.
3. Polymer coating: 1.7 g/L of an acrylic acid/acrylamide copolymer (14% actives) in water applied as a 30 second spray at ambient temperatures.
4. Drying.

Treatment I—No Rinse

1. Acid treatment: 2% by weight mixture of $H_2TiF_6$ and an acrylic acid/acrylamide polymer available commercially from Betz Laboratories, in water at pH 2.2–2.5 and applied at ambient temperature in a 30 second spray.
2. Drying.

Treatment J

1. Acid treatment: 40 second immersion in a 3% by volume aqueous solution of chromic acid and phosphoric acid (Permatreat® 640) mixed with 0.5% by volume aqueous solution of HF (Permatreat® 645) at a temperature of about 100°–120° F.
2. Tap water rinse.
3. Deionized water rinse.
4. Drying.

The results of the test are shown in Table IIB.

TABLE IIB

Boiling Water/Adhesion Results

| Treatment | PPG Polycron White UC 63031 | PPG Polycron Black UC67042 | Morton Bronze 101T216 | Morton Linen White 101W146 | PPG Polycron Brown UCS8175 |
|---|---|---|---|---|---|
| E | 4/4/0 | 0/0/0 | 6/6/4 | 6/3/0 | 0/0/0 |
| F | 10/10/9 | 5/5/5 | 7/3/3 | 8/6/6 | 6/6/5 |
| G | 10/10/10 | 10/8/6 | 10/9/8 | 10/10/10 | 10/10/10 |
| H | 10/10/10 | 8/7/7 | 10/10/10 | 10/10/10 | 8/7/6 |
| I | 5/5/5 | 5/5/5 | 7/6/4 | 8/6/6 | 7/6/5 |
| J | 8/8/8 | 7/7/7 | 9/8/7 | 9/7/7 | 9/6/6 |

Example II shows that the multi-stage treatments F, G and H provided superior paint adhesion than no rinse treatment E and I, and the chrome phosphate treatment J.

EXAMPLE III

Extruded aluminum panels were cleaned, treated, painted, scored, boiled, and taped as described in Example I. The treatments are shown in Table IIIA.

TABLE IIIA

Treatment K—Multi-Step

1. Acid treatment: 7.8 g/L of $H_2ZrF_6$ (45% actives) in water at a pH of 2.8 and a temperature of 115° F. applied as a 30 second spray.
2. Tap water rinse.
3. Polymer coating: 15 g/L of a mixture of 2% by volume Acumer® 1510 (25% actives) and 0.4% by volume Airvol® 740 in water, applied at ambient temperature in a 30 second spray.
4. Drying.

Treatment L—Multi-Step

1. Acid treatment: 3.9 g/L of $H_2ZrF_6$ (45% active) and 3 gm/L of $H_2TiF_6$ (60% active) in water at pH of 2.8 and a temperature of 115° F. applied as a 30 second spray.
2. Tap water rinse.
3. Polymer coating: 80 g/L of a mixture of 2.5% by volume Acumer® 1510 (25% actives) and 0.5% by volume Airvol® 740 in water applied as a 30 second spray.
4. Drying.

Treatment M—Multi-Step

1. Acid treatment: 6 g/L of $H_2TiF_6$ (60% active) in water at pH of 2.8 and a temperature of 115° F. applied as a 30 second spray.
2. Rinse with tap water.
3. Polymer coating: 80 g/L of a mixture of 2.5% by volume Acumer® 1510 (25% actives) and 0.5% by volume Airvol® 7.40 in water applied as a 30 second spray.
4. Drying.

Treatment N—Chrome phosphate

1. Acid treatment: 40 second immersion in a 3% by volume aqueous solution of chromic and phosphoric acid (Permatreat® 640) mixed with 0.5% by volume aqueous solution of HF (Permatreat® 645) at a temperature of 100°–120° F.
2. Tap water rinse.

3. Deionized water rinse.
4. Drying.

The results of the test are shown in Table IIIB.

TABLE IIIB

Boiling Water/Adhesion Results

| Treatment | PPG White UC63031 | Morton Med. Bronze 101T216 | PPG Black UC67042 |
|---|---|---|---|
| K | 10/10/10 | 10/10/9 | 10/9/7 |
| L | 10/10/10 | 10/9/8 | 8/8/7 |
| M | 10/10/10 | 10/9/6 | 8/7/7 |
| N | 6/6/5 | 6/6/6 | 4/4/4 |

Example III shows that the multi-stage treatments K, L and M provided superior paint adherence to a chrome phosphate treatment N.

Example IV

Extruded aluminum panels were cleaned, treated, painted, scored, boiled and taped as described in Examples I–III. The acid treatment consisted of 6 g/L of $H_2TiF_6$ (60% active) in water at 115° F., and applied as a 30 second spray. The panels were rinsed with tap water and then spray sealed with various polymeric coatings in a 30 second spray followed by drying. The polymeric sealers and results are shown in Table IV.

TABLE IV

Boiling Water/Adhesion Results

| Sealer | Morton Linen White 101W146 | Morton Bronze 101T216 | PPG Walnut Brown UC58175 | PPG Black UC67042 |
|---|---|---|---|---|
| 1 g/L Acumer 1510[1] | 10/9/9 | 5/5/5 | 4/3/3 | 5/4/4 |
| 0.2 g/L Airvol 740[2] | 10/10/10 | 7/6/6 | 4/4/6 | 3/5/4 |
| 1 g/L Acumer 1510[1] and 0.2 g/L Airvol 740 | 10/10/10 | 9/8/7 | 7/6/6 | 5/4/4 |
| 1 g/L Acumer 1510[1] and 0.4 g/L Airvol 740 | 10/10/10 | 9/9/9 | 9/5/5 | 6/6/5 |
| 1.7 g/L AA/AM[3] and 0.2 g/L Airvol 740 | 10/10/10 | 9/9/9 | 9/8/7 | 8/8/6 |

Where:

1 25% actives polyacrylic acid

2 Polyvinylalcohol 3 14% actives Acrylic Acid/Acrylamide Copolymer having a molar ratio of acrylic acid to acrylamide of 7:3.

Table IV shows that effective paint adhesion to aluminum is obtained by using polyacrylamide, polyvinylalcohol, acrylic acid/acrylamide copolymers and mixtures thereof.

The examples clearly show that the present invention process provides excellent siccative coating adherence to aluminum surfaces and thus improves the corrosion protection of aluminum surfaces treated with the invention process without the need for phosphate ions, tannin compounds, hafnium ions or sequestering agents in the acidic solution.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

We claim:

1. A method for coating the surface of a metal selected from the group consisting of aluminum and aluminum alloys wherein aluminum is the principal ingredient, said method comprising:

sequentially, a) cleaning said surface of said metal with a cleaning solution;

b) rinsing said cleaning solution from said surface of said metal with water;

c) contacting said surface of said metal with an acidic solution consisting essentially of water and an acid selected from the group consisting of $H_2TiF_6$, $H_2ZrF_6$, $HBF_4$, $H_2SiF_6$ and mixtures thereof wherein said acidic solution is free of phosphate ions, tannin compounds, sequestering agents, and hafnium ions;

d) rinsing said acidic solution from said surface of said metal with water; and e) coating said surface of said metal with an aqueous polymeric composition comprising water and a polymer selected from the group consisting of polyacrylic acid, polyvinyl alcohol, acrylic acid/acrylamide copolymers, and mixtures thereof.

2. The method of claim 1 wherein said cleaning solution is an aqueous alkaline degreasing solution.

3. The method of claim 2 wherein said water of steps b) and d) is tap water.

4. The method of claim 3 wherein said water of step b) contains phosphoric acid or nitric acid as an alkaline neutralizing agent.

5. The method of claim 1 wherein the concentration of said acid in said acidic solution is from about 1 g/L to about 100 g/L of said acid in said water.

6. The method of claim 5 wherein the concentration of said polymer in said aqueous polymeric solution is from about 0.1 g/L to about 10 g/L.

7. A method for coating the surface of a metal selected from the group consisting of aluminum and aluminum alloys wherein aluminum is the principal ingredient, said method comprising:

sequentially, a) cleaning said surfaces of said metal with an alkaline cleaning solution;

b) rinsing said cleaning solution from said surface of said metal with water;

c) contacting said surface of said metal with an acidic solution consisting essentially of from about 1 g/L to about 100 g/L of an acid, selected from the group consisting of $H_2TiF_6$, $H_2ZrF_6$, $HBF_4$, $H_2SiF_6$ and mixtures thereof, in water, wherein said acidic solution is free of phosphate ions, tannin compounds, sequestering agents, and hafnium ions;

d) rinsing said acidic solution from said surface of said metal with water; and e) coating said surface of said metal with an aqueous polymeric solution comprising from about 1.0 g/L to about 10 g/L of a polymer selected from the group consisting of polyacrylic acid, polyvinylalcohol, acrylic acid/acrylamide copolymer and mixtures thereof, in water.

8. A method for coating the surface of a metal selected from the group consisting of aluminum and aluminum alloys wherein aluminum is the principal ingredient, said method comprising:

sequentially, a) cleaning said surface of said metal with an alkaline cleaning solution;

b) rinsing said cleaning solution from said surface of said metal with water;

c) contacting said surface of said metal with an acid solution consisting essentially of from about 3 g/L to about 15 g/L of $H_2TiF_6$, $H_2ZrF_6$ or mixtures thereof in water, wherein said acidic solution is free of phosphorous ions, tannin compounds, sequestering agents and hafnium ions;

d) rinsing said acidic solution from said surface of said metal with water; and e) coating said surface of said metal with an aqueous polymeric solution comprising from about 0.2 g/L to about 1 g/L of a mixture of acrylic acid/acrylamide copolymer and polyvinylalcohol wherein the parts by weight ratio of said acrylic acid/acrylamide copolymer to said polyvinylalcohol is from about 4:3 to about 5:12 and the molar ratio of acrylic acid to acrylamide in said copolymer is about 7:3.

* * * * *